US008910408B2

(12) United States Patent
Masters et al.

(10) Patent No.: US 8,910,408 B2
(45) Date of Patent: Dec. 16, 2014

(54) FIREARM WITH BARREL CINCHING CLAMP

(71) Applicants: Philip Masters, Portsmouth (GB); Ian Scrace, Portsmouth (GB); David Walls, Portsmouth (GB)

(72) Inventors: Philip Masters, Portsmouth (GB); Ian Scrace, Portsmouth (GB); David Walls, Portsmouth (GB)

(73) Assignee: Accuracy International of North America, Inc., Fredericksburg, VA (US)

( * ) Notice: Subject to any disclaimer, the term of this patent is extended or adjusted under 35 U.S.C. 154(b) by 124 days.

(21) Appl. No.: 13/719,762

(22) Filed: Dec. 19, 2012

(65) Prior Publication Data

US 2014/0165444 A1 Jun. 19, 2014

(51) Int. Cl.
*F41A 21/00* (2006.01)
*F41A 21/48* (2006.01)

(52) U.S. Cl.
CPC ..... *F41A 21/484* (2013.01)
USPC ..... 42/75.02; 42/75.01

(58) Field of Classification Search
CPC ..... F41A 21/48; F41A 21/481; F41A 21/482; F41A 21/484; F41A 21/485; F41A 21/487; F41A 21/488
See application file for complete search history.

(56) References Cited

U.S. PATENT DOCUMENTS

| | | | | | |
|---|---|---|---|---|---|
| 1,194,024 | A * | 8/1916 | Johnson | 42/75.02 |
| 2,155,498 | A * | 4/1939 | Laudensack | 42/75.01 |
| 2,437,137 | A * | 3/1948 | Swebilius | 42/75.02 |
| 3,711,980 | A * | 1/1973 | Palama' | 42/16 |
| 3,731,418 | A * | 5/1973 | Birkenhagen et al. | 42/75.02 |
| 3,834,053 | A * | 9/1974 | Bielfeldt et al. | 42/75.02 |
| 3,883,977 | A * | 5/1975 | McClure | 42/75.02 |
| 4,429,614 | A * | 2/1984 | Tocco | 89/14.3 |
| 5,155,284 | A * | 10/1992 | Flashkes | 42/75.02 |
| 5,540,008 | A * | 7/1996 | Kirnstatter | 42/75.02 |
| 7,104,000 | B2 * | 9/2006 | Orth | 42/71.01 |
| 7,451,564 | B2 * | 11/2008 | Wait | 42/75.02 |
| 8,037,633 | B1 * | 10/2011 | Troy | 42/71.01 |
| 8,234,808 | B2 * | 8/2012 | Lewis et al. | 42/73 |
| 8,448,367 | B2 * | 5/2013 | Samson et al. | 42/75.02 |
| 8,561,337 | B2 * | 10/2013 | Lewis et al. | 42/73 |
| 8,689,478 | B2 * | 4/2014 | Patel | 42/75.02 |
| 8,713,833 | B2 * | 5/2014 | Lewis et al. | 42/16 |
| 2005/0188584 | A1 * | 9/2005 | Orth | 42/71.01 |
| 2005/0188591 | A1 * | 9/2005 | Stone | 42/75.02 |
| 2005/0229463 | A1 * | 10/2005 | Tashjian | 42/75.02 |
| 2007/0186458 | A1 * | 8/2007 | Wait | 42/75.02 |
| 2012/0186123 | A1 * | 7/2012 | Troy et al. | 42/71.01 |
| 2013/0205637 | A1 * | 8/2013 | Patel | 42/75.02 |
| 2013/0219765 | A1 * | 8/2013 | Ibarguren | 42/75.02 |

* cited by examiner

*Primary Examiner* — Bret Hayes
*Assistant Examiner* — Joshua Freeman
(74) *Attorney, Agent, or Firm* — Bennet K. Langlotz; Langlotz Patent & Trademark Works, Inc.

(57) ABSTRACT

Firearms with barrel cinching clamps have a receiver having a forward portion defining an internally threaded bore, a barrel having a threaded end removably received in the bore, at least a selected portion of the forward portion being split by a gap, the selected portion having connection elements on opposite sides of the gap, and an adjustable element connected to the connection elements and operable to narrow the gap to secure the barrel in the bore and to widen the gap to permit the barrel to be readily unscrewed from the bore. The bore may define a bore axis, and the gap may be parallel to the bore axis. A circumferentially complete portion of the threaded bore including a plurality of threads adjacent to the gap may be unbroken by a gap. The circumferentially complete portion of the threaded bore may be forward and/or rearward of the selected portion.

20 Claims, 4 Drawing Sheets

FIREARM WITH BARREL CINCHING CLAMP

FIELD OF THE INVENTION

The present invention relates to firearms, and more particularly to firearms with changeable barrels.

BACKGROUND OF THE INVENTION

Firearms with changeable barrels are desirable because the barrel can be replaced as the barrel becomes damaged or too hot, to change the firearm's caliber, or for more compact storage of the firearm.

Heavy machine guns, particularly those with air cooled barrels, often require barrel changes in the field because the barrel has become too hot for continued use without permanently damaging the barrel. Various quick-change mechanisms using latches or pins have been developed to permit rapid barrel replacement of heavy machine guns.

Although a variety of bolt action and semi-automatic and automatic rifles permit barrel changes, they typically require specialized tools. For example, to change an AR-15 barrel, the upper receiver is held in a vise block to provide a secure and steady hold on the upper receiver, a specialized barrel nut wrench is used to unscrew the barrel nut so the barrel can be removed, and a torque wrench must be attached to the specialized barrel nut wrench in order to tighten the barrel nut once the new barrel is in place. An alternative modular rifle system design eliminates the need for a vise block, but requires attaching a specialized takedown/assembly tool to the receiver and using a gear drive torque wrench to engage gear teeth on a specialized barrel design in order to tighten and loosen the barrel.

The disadvantages of both of these approaches are the need for specialized tools and associated difficulties associated with changing barrels in the field. Not only is there a risk of under torqueing or over torqueing the receiver or barrel nut, resulting in loosening or breakage, but it is also easy to lose the aim of an attached scope. The user may not notice the misalignment of the scope until after taking a shot that misses or strikes an unintended target.

Therefore, a need exists for a new and improved firearm that can be used to change barrels having a standard barrel thread in such a manner that under torqueing or over torqueing are not possible and an attached scope is unlikely to be disturbed. In this regard, the various embodiments of the present invention substantially fulfill at least some of these needs. In this respect, the firearm with barrel cinching clamp according to the present invention substantially departs from the conventional concepts and designs of the prior art, and in doing so provides an apparatus primarily developed for the purpose of facilitating barrel replacement when the barrel becomes damaged or too hot, to change the firearm's caliber, or for more compact storage of the firearm.

SUMMARY OF THE INVENTION

The present invention provides an improved firearm with barrel cinching clamp, and overcomes the above-mentioned disadvantages and drawbacks of the prior art. As such, the general purpose of the present invention, which will be described subsequently in greater detail, is to provide an improved firearm with barrel cinching clamp that has all the advantages of the prior art mentioned above.

To attain this, the preferred embodiment of the present invention essentially comprises a receiver having a forward portion defining an internally threaded bore, a barrel having a threaded end removably received in the bore, at least a selected portion of the forward portion being split by a gap, the selected portion having connection elements on opposite sides of the gap, and an adjustable element connected to the connection elements and operable to narrow the gap to secure the barrel in the bore and to widen the gap to permit the barrel to be readily unscrewed from the bore. The bore may define a bore axis, and the gap may be parallel to the bore axis. A circumferentially complete portion of the threaded bore including a plurality of threads adjacent to the gap may be unbroken by a gap. The circumferentially complete portion of the threaded bore may be forward and/or rearward of the selected portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
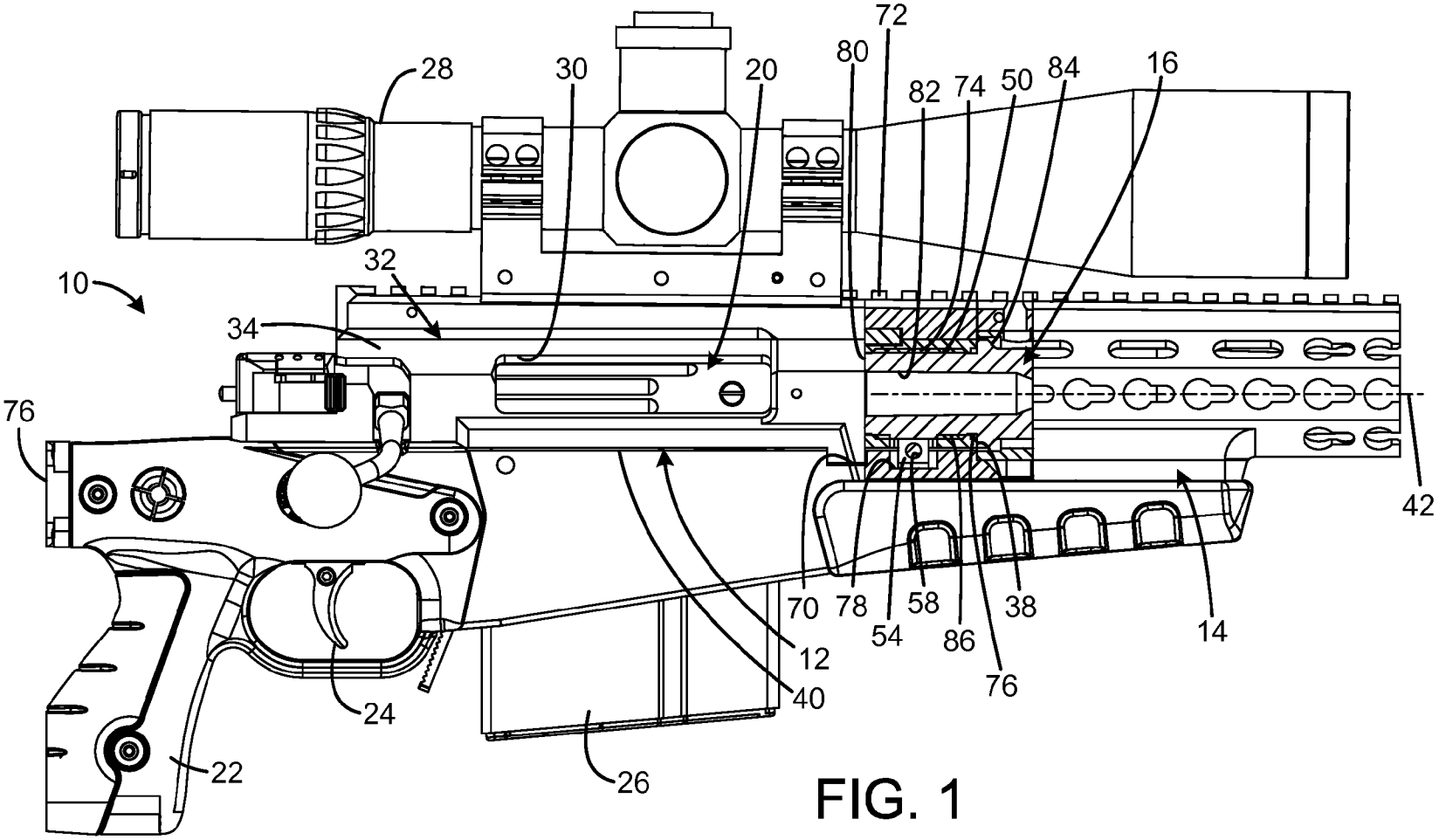
FIG. 1 is a side cutaway view of the current embodiment of the firearm with barrel cinching clamp constructed in accordance with the principles of the present invention.

A preferred embodiment of the firearm with barrel cinching clamp of the present invention is shown and generally designated by the reference numeral 10.

FIG. 1 illustrates improved firearm with barrel cinching clamp of the present invention. More particularly, the firearm with barrel cinching clamp 10 is a rifle. The rifle has a pistol grip 22 at its rear 76, a trigger 24, a magazine 26, a receiver 12, and a barrel 16. The barrel has a central bore (the chamber 82 portion is visible) that defines a bore axis 42. The barrel is threadedly connected to the front 38 of the receiver. A chassis 14 is connected to the bottom 40 of the receiver. A scope 28 is attached to a rail 72 formed by the top 32 of the receiver. The right side 34 of the receiver defines an ejection port 30. A bolt carrier 20 is slidably received within the receiver.

The front 38 of the receiver defines a threaded bore 50. The rear 80 of the barrel has barrel threads up until the point where a flange 84 circumferentially protrudes from the barrel. The barrel threads engage the threaded bore to secure the barrel in place. A clearance space 76 exists between the bore threads 86 and the flange to facilitate the mating of the barrel threads with the bore threads. A clearance space also exists between the top 78 of the chassis 14 and the right boss 52 and left boss 54 (only the left boss 54 is visible) that extend downwards from the bottom 40 of the receiver so the bosses are free to move. The bosses will be described in more detail subsequently.

Figure 2:
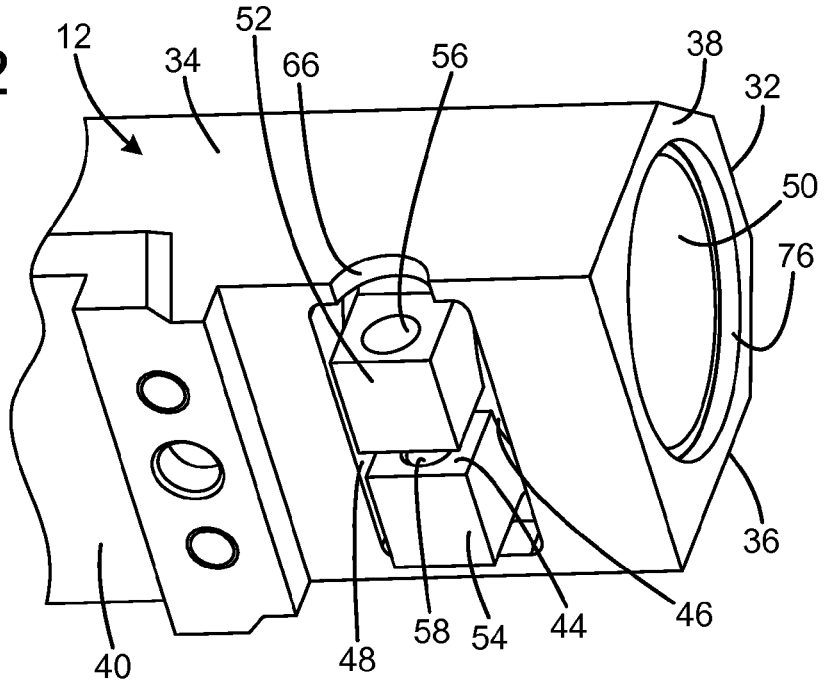
FIG. 2 is a bottom isometric fragmentary view of the current embodiment of the receiver of the present invention.

FIG. 2 illustrates the bottom 40 of the front 38 of the receiver 12 of the present invention. More particularly, the bottom 40 defines a right boss 52 and a left boss 54. The bosses are essentially cubes when viewed from below. The bosses are separated from one another by a central gap 44, and they are also separated from the receiver by side gaps 46 and 48. The right boss has a clearance hole 56 that is a smooth bore, and the left boss has a threaded bore 58. The right side 34 of the receiver defines a semicircular slot 66 above the clearance hole 56.

Figure 3:
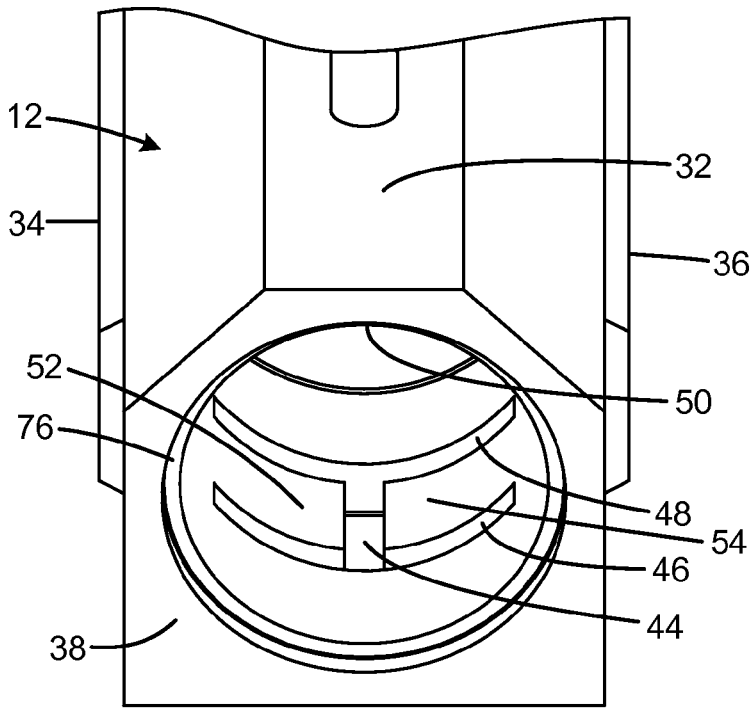
FIG. 3 is a top isometric fragmentary view of the current embodiment of the receiver of the present invention.

FIG. 3 illustrates the threaded bore 50 in the front 38 of the receiver 12 of the present invention. More particularly, the threaded bore is circumferentially completely threaded rearward of the clearance space 76 except for where the central gap 44 and side gaps 46, 48 are present. The central gap and side gaps to combine to form an H shape, with the central gap being parallel to the bore axis 42 (shown in FIG. 4) and the side gaps being transverse to the bore axis. The side gaps extend circumferentially about less than one fourth of the circumference of the threaded bore. The right boss 52 and left boss 54 also include thread segments where they abut the threaded bore.

Figure 4:
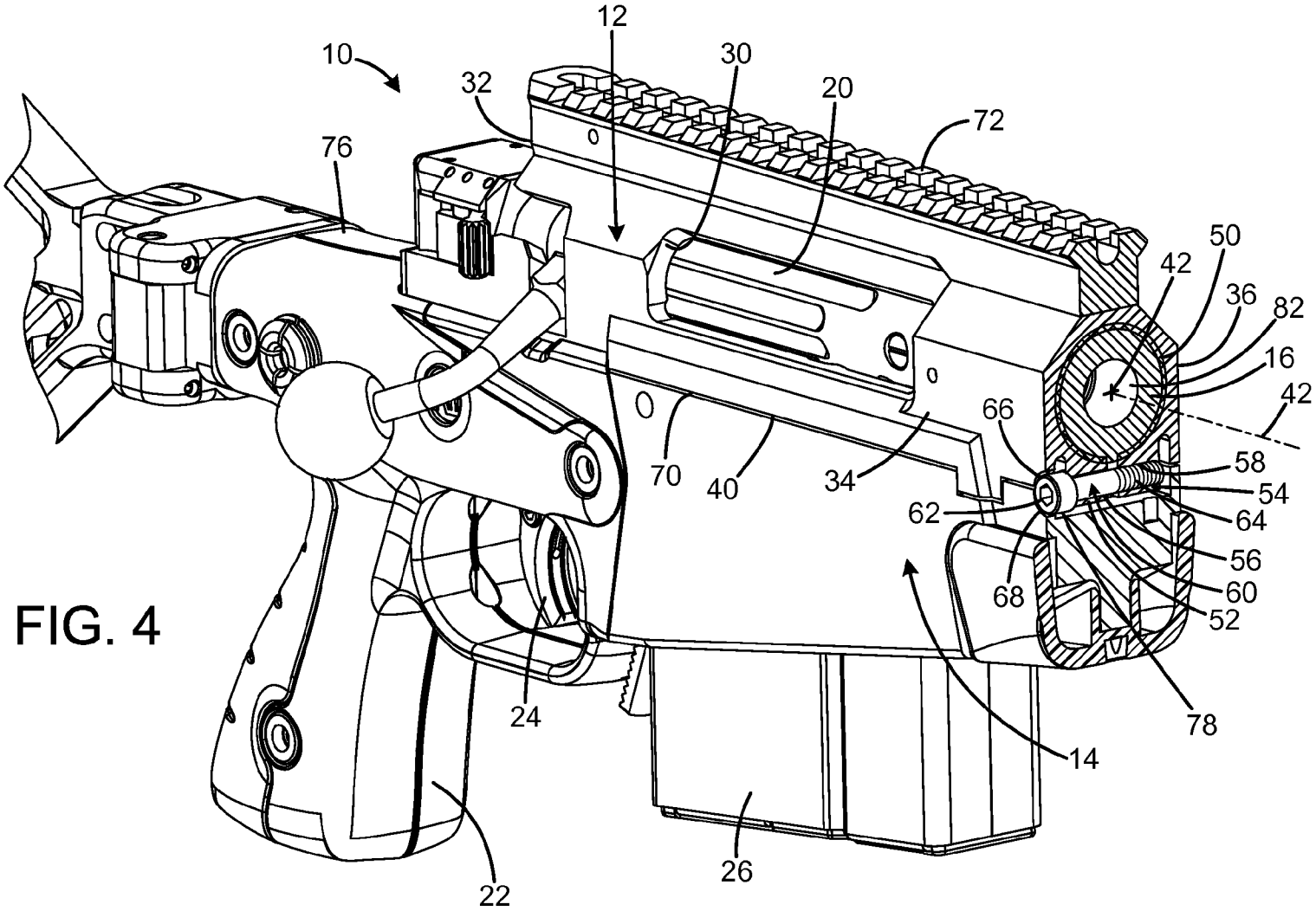
FIG. 4 is a top isometric sectional view of the current embodiment of the firearm with barrel cinching clamp of FIG. 1.
Figure 5:
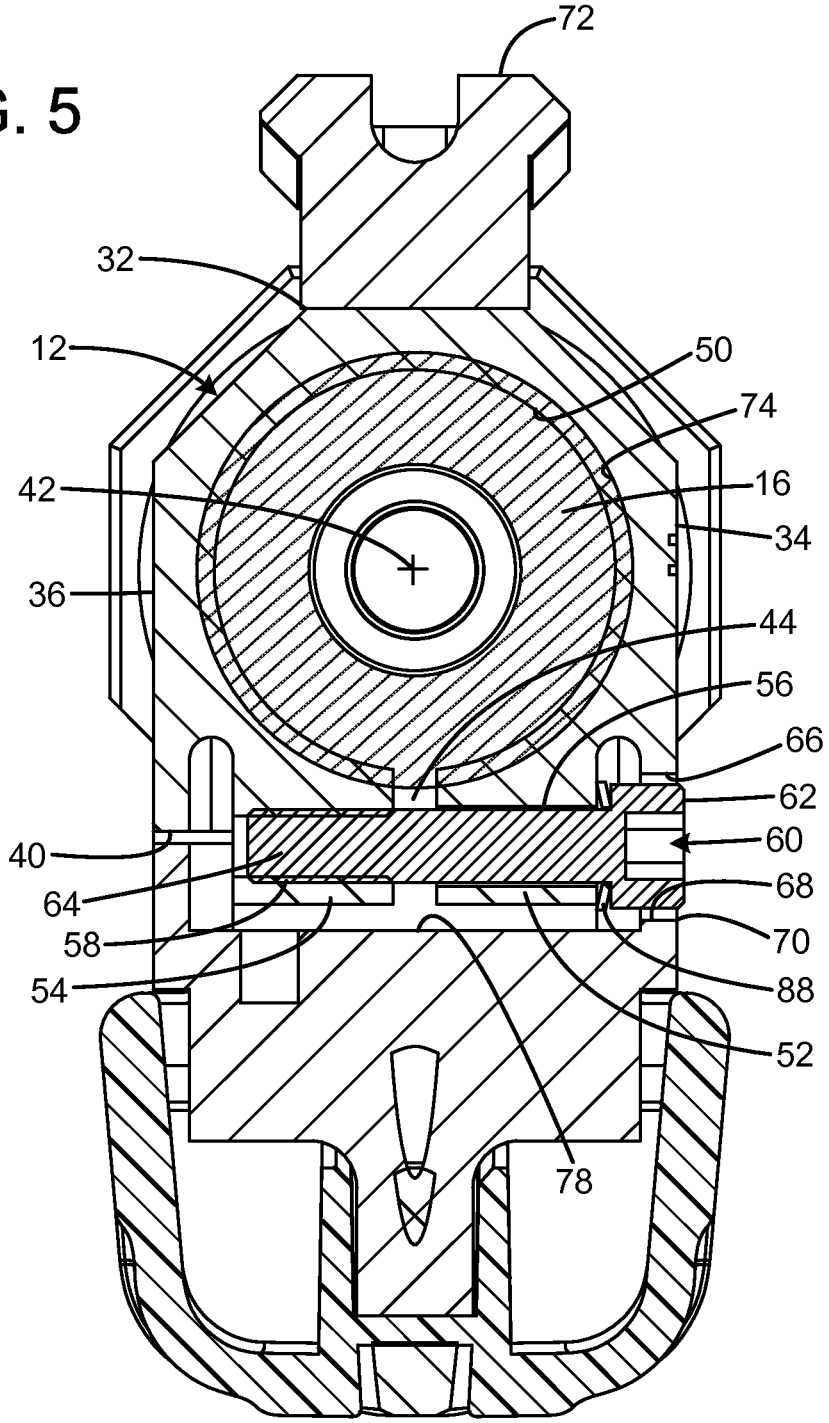
FIG. 5 is a rear view of the current embodiment of the firearm with barrel cinching clamp of FIG. 1.

FIGS. 4 & 5 illustrate the improved firearm with barrel cinching clamp of the present invention. More particularly, the firearm with barrel cinching clamp 10 is depicted cut sectionally through the chamber 82. The cut is viewed from the front in FIG. 4 and from the rear in FIG. 5. A hex bolt 60 is inserted through a circular opening defined by the semicircular slot 66 in the bottom 40 of the receiver 12 and a semicircular slot 68 in the top 70 of the chassis 14. The semicircular slots are sized to not obstruct rotation and axial movement of the hex bolt head 62 and to provide access to the hex bolt head. The threaded portion 64 passes through the clearance hole 56 in the right boss 52, which is sized to permit free passage of the threaded portion and to obstruct the hex bolt head, and threadedly engages the threaded bore 58 in the left boss 54.

Tightening the hex bolt head 62 creates a clamping action between the hex bolt head 62 and the threaded portion 64 engaged with the threaded bore 58 in the left boss 54. The clamping action draws the right boss 52 and left boss 54 together, thereby securing the barrel 16 in position within the threaded bore 50 in the front 38 of the receiver 12 by narrowing the central gap 44. A clearance space 78 between the right and left bosses and the chassis 14 permits the bosses to be drawn together. A belleville washer 88 is located below the hex bolt head to give a flexible quality to the bolted joint.

To remove the barrel 16 from the receiver, the hex bolt 60 is loosened by rotating the hex bolt head 62 counterclockwise. With the clamping pressure released, the right boss 52 and left boss 54 spring back to their uncinched positions and return the central gap 44 to its original width. In this position, the right boss and left boss permit the barrel to be readily unscrewed from the threaded bore 50 in the front 38 of the receiver 12. Subsequently, the barrel can be pulled forward for withdrawal and replaced with a new barrel of the desired caliber. The hex bolt is then replaced and tightened to secure the new barrel in position.

The hex bolt 60 of the current invention can be tightened and loosened by a conventional Allen wrench rather than a specialized tool. In addition, an appropriately sized Allen wrench may be securely received in the buttstock of the firearm 10 to make the wrench readily available to the user in the field.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of the firearm with barrel cinching clamp has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A rifle comprising:

a receiver having a forward portion defining an internally threaded bore;

a barrel having a threaded end removably received in the bore;

at least a selected portion of the forward portion being split by a gap;

the selected portion having connection elements on opposite sides of the gap;

wherein a circumferentially complete portion of the threaded bore including a plurality of threads adjacent to the gap is unbroken by a gap; and an adjustable element connected to the connection elements and operable to narrow the gap to secure the barrel in the bore, and to widen the gap to permit the barrel to be readily unscrewed from the bore.

2. The rifle of claim 1 wherein the bore defines a bore axis, and wherein the gap is parallel to the bore axis.

3. The rifle of claim 2 wherein each connection element has an inner facing surface defining thread segments, and has a boss portion radially extending from the bore axis.

4. The rifle of claim 3 wherein the boss portions include attachment facilities operable for engagement by the adjustable element.

5. The rifle of claim 3 wherein the adjustable element is a threaded fastener having a head, and wherein a first one of the attachment facilities defines a threaded bore for connection with the threaded fastener, and a second of the attachment facilities having a clearance hole for passing a portion of the fastener, and having a surface for contacting the head of the fastener.

6. The rifle of claim 1 wherein the circumferentially complete portion of the threaded bore is forward of the selected portion.

7. The rifle of claim 1 wherein the circumferentially complete portion of the threaded bore is rearward of the selected portion.

8. The rifle of claim 1 including a first circumferentially complete portion of the threaded bore that is forward of the selected portion, and a second circumferentially complete portion of the threaded bore that is rearward of the selected portion.

9. The rifle of claim 8 wherein the bore defines a bore axis, and wherein the connection elements are separated from the first and second circumferentially complete portion of the threaded bore by a side gap transverse to the bore axis.

10. The rifle of claim 9 wherein the side gap extends circumferentially about a minority of the circumference of the bore.

11. The rifle of claim 9 wherein the side gap extends circumferentially about less than ¼ of the circumference of the bore.

12. The rifle of claim 1 wherein the rifle includes a chassis at least partially enclosing the receiver and barrel, the chassis defining slot registered with the adjustable element, such that access is provided to the adjustable element to permit barrel replacement without removal of the chassis.

13. The rifle of claim 1 wherein the adjustable element is a threaded fastener threadedly engaged to one of the connection elements, and having a head engaged to the other connection element, such that tightening of the fastener draws the connection elements together to secure a barrel in the bore.

14. The rifle of claim 1 wherein the rifle includes a chassis at least partially enclosing the receiver and barrel, the chassis defining a slot registered with the adjustable element, such that access is provided to the adjustable element to permit barrel replacement without removal of the chassis.

15. The rifle of claim 1 wherein the adjustable element is a threaded fastener threadedly engaged to one of the connection elements, and having a head engaged to the other connection element, such that tightening of the fastener draws the connection elements together to secure a barrel in the bore.

16. A rifle comprising:

a receiver having a forward portion defining an internally threaded bore;

a barrel having a threaded end removably received in the bore;

at least a selected portion of the forward portion being split by a gap;

the selected portion having connection elements on opposite sides of the gap;

a first circumferentially complete portion of the threaded bore that is forward of the selected portion;

a second circumferentially complete portion of the threaded bore that is rearward of the selected portion; and an adjustable element connected to the connection elements and operable to narrow the gap to secure the barrel in the bore, and to widen the gap to permit the barrel to be readily unscrewed from the bore.

17. The rifle of claim 16 wherein the bore defines a bore axis, and wherein the gap is parallel to the bore axis.

18. The rifle of claim 16 wherein the bore defines a bore axis, and wherein the connection elements are separated from the first and second circumferentially complete portions of the threaded bore by a side gap transverse to the bore axis.

19. The rifle of claim 18 wherein the side gap extends circumferentially about a minority of the circumference of the bore.

20. The rifle of claim 18 wherein the side gap extends circumferentially about less than ¼ of the circumference of the bore.

* * * * *